US011275334B2

(12) United States Patent
Kobayashi et al.

(10) Patent No.: US 11,275,334 B2
(45) Date of Patent: Mar. 15, 2022

(54) IMAGE FORMING APPARATUS AND RECORDING MEDIUM

(71) Applicant: Konica Minolta, Inc., Tokyo (JP)

(72) Inventors: Kazutoshi Kobayashi, Toyokawa (JP); Tomohiro Kawasaki, Sagamihara (JP); Keiki Katsumata, Hachioji (JP); Kei Okamura, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/320,702

(22) Filed: May 14, 2021

(65) Prior Publication Data

US 2021/0364968 A1 Nov. 25, 2021

(30) Foreign Application Priority Data

May 22, 2020 (JP) ..... JP2020-089330

(51) Int. Cl.
*G03G 15/00* (2006.01)
*G03G 15/08* (2006.01)

(52) U.S. Cl.
CPC ..... *G03G 15/5041* (2013.01); *G03G 15/0887* (2013.01); *G03G 15/0896* (2013.01); *G03G 2221/0021* (2013.01)

(58) Field of Classification Search
CPC ..... G03G 15/5041; G03G 15/0887; G03G 15/0896; G03G 2221/0021
See application file for complete search history.

(56) References Cited

U.S. PATENT DOCUMENTS 4,974,023 A * 11/1990 Aimoto ..... G03G 15/0896 399/119
2018/0284651 A1* 10/2018 Sunayama ..... G03G 15/0865
2019/0235417 A1* 8/2019 Sakurada ..... G03G 15/0896

FOREIGN PATENT DOCUMENTS

JP 2019-144333 A 8/2019

* cited by examiner

*Primary Examiner* — Sandra Brase
(74) *Attorney, Agent, or Firm* — Squire Patton Boggs (US) LLP

(57) ABSTRACT

Provided is an image forming apparatus including a developer that performs development with toner, the image forming apparatus including a vibrator that applies vibrations to a vibrated portion of the developer, and a hardware processor that controls the vibrator. The hardware processor determines a toner leakage level based on a result of detecting toner leakage adhering to a sheet caused by the image forming apparatus, settles a vibrating condition of the vibrator in accordance with the toner leakage level, and causes the vibrator to perform a vibrating operation under the settled vibrating condition.

14 Claims, 7 Drawing Sheets

IMAGE FORMING APPARATUS AND RECORDING MEDIUM

CROSS-REFERENCE TO RELATED APPLICATIONS

The entire disclosure of Japanese Patent Application No. 2020-089330 filed on May 22, 2020 is incorporated herein by reference in its entirety.

BACKGROUND

Technological Field

The present invention relates to an image forming apparatus and a recording medium.

Description of the Related Art

In an image forming apparatus through use of an electrophotographic process technology, a surface of a photosensitive drum which is an image carrier is electrically charged by a charging device, and is irradiated with laser light based on image data to form an electrostatic latent image on the surface of the photosensitive drum. A developer is supplied from a developing device to this photosensitive drum to visualize the electrostatic latent image, so that a toner image is formed on the photosensitive drum. The toner image is then transferred to and fixed on a sheet to form an image on the sheet.

JP 2019-144333 A, for example, discloses an image forming apparatus including a vibrator that applies vibrations to a developing device. With this image forming apparatus, toner adhering to the developing device is shook off to restrain agglomeration, thereby restraining an image failure.

SUMMARY

With the technique disclosed in JP 2019-144333 A, however, a vibrating operation may not be performed at a suitable time. In addition, the vibrating operation performed by the vibrator is constant, and thus may become inefficient for a reason such as excessively strong vibrations in a case where the quantity of adhering toner is small, or a failure in completely shaking off toner in a case where the quantity of adhering toner is large.

The present invention was made in view of such circumstances, and has an object to provide an image forming apparatus and a program that enable an image failure that would be caused by toner to be suitably restrained by performing a vibrating operation efficiently at a suitable time.

To achieve at least one of the abovementioned objects, according to an aspect of the present invention, an image forming apparatus reflecting one aspect of the present invention is an image forming apparatus including a developer that performs development with toner, the image forming apparatus comprising: a vibrator that applies vibrations to a vibrated portion of the developer; and a hardware processor that controls the vibrator, wherein the hardware processor determines a toner leakage level based on a result of detecting toner leakage adhering to a sheet caused by the image forming apparatus, settles a vibrating condition of the vibrator in accordance with the toner leakage level, and causes the vibrator to perform a vibrating operation under the settled vibrating condition.

To achieve at least one of the abovementioned objects, according to another aspect of the present invention, a recording medium reflecting one aspect of the present invention is a non-transitory recording medium storing a computer readable program that causes a computer of an image forming apparatus including a developer that performs development with toner, and a vibrator that applies vibrations to a vibrated portion of the developer to perform: determining a toner leakage level based on a result of detecting toner leakage adhering to a sheet caused by the image forming apparatus, settling a vibrating condition of the vibrator in accordance with the toner leakage level, and causing the vibrator to perform a vibrating operation under the settled vibrating condition.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF THE EMBODIMENTS

Hereinafter, a configuration of an image forming apparatus which is an embodiment of the present invention will be described in detail based on the drawings. However, the scope of the invention is not limited to the disclosed embodiments.

Figure 1:
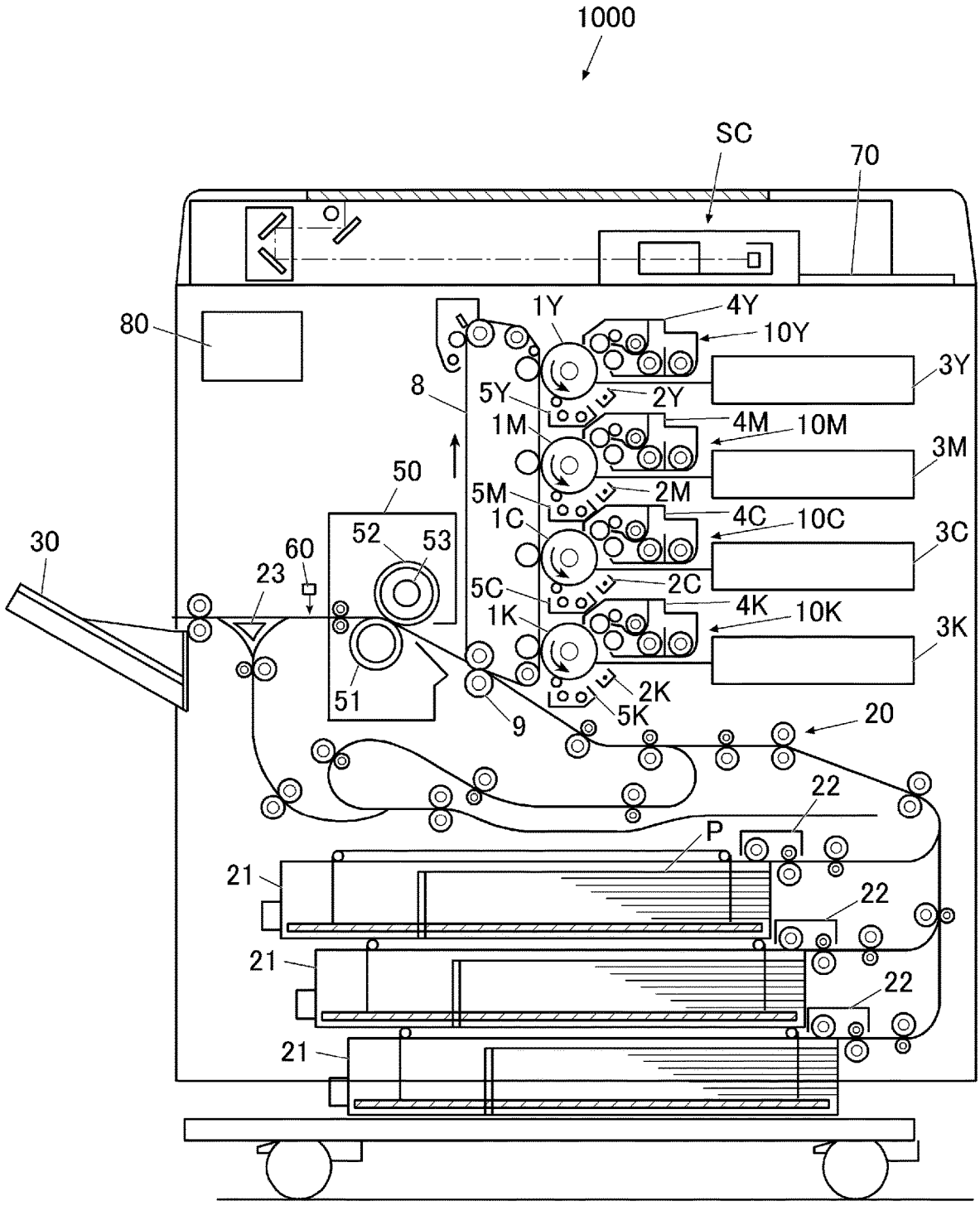
FIG. 1 is a configuration diagram schematically showing an image forming apparatus according to an embodiment.

FIG. 1 is a configuration diagram schematically showing an image forming apparatus 1000 according to the present embodiment. The image forming apparatus 1000 according to the present embodiment is an electrophotographic image forming apparatus, for example, and is what is called a tandem-type color image forming apparatus that forms a full-color image.

[Image Forming Apparatus]

Figure 2:
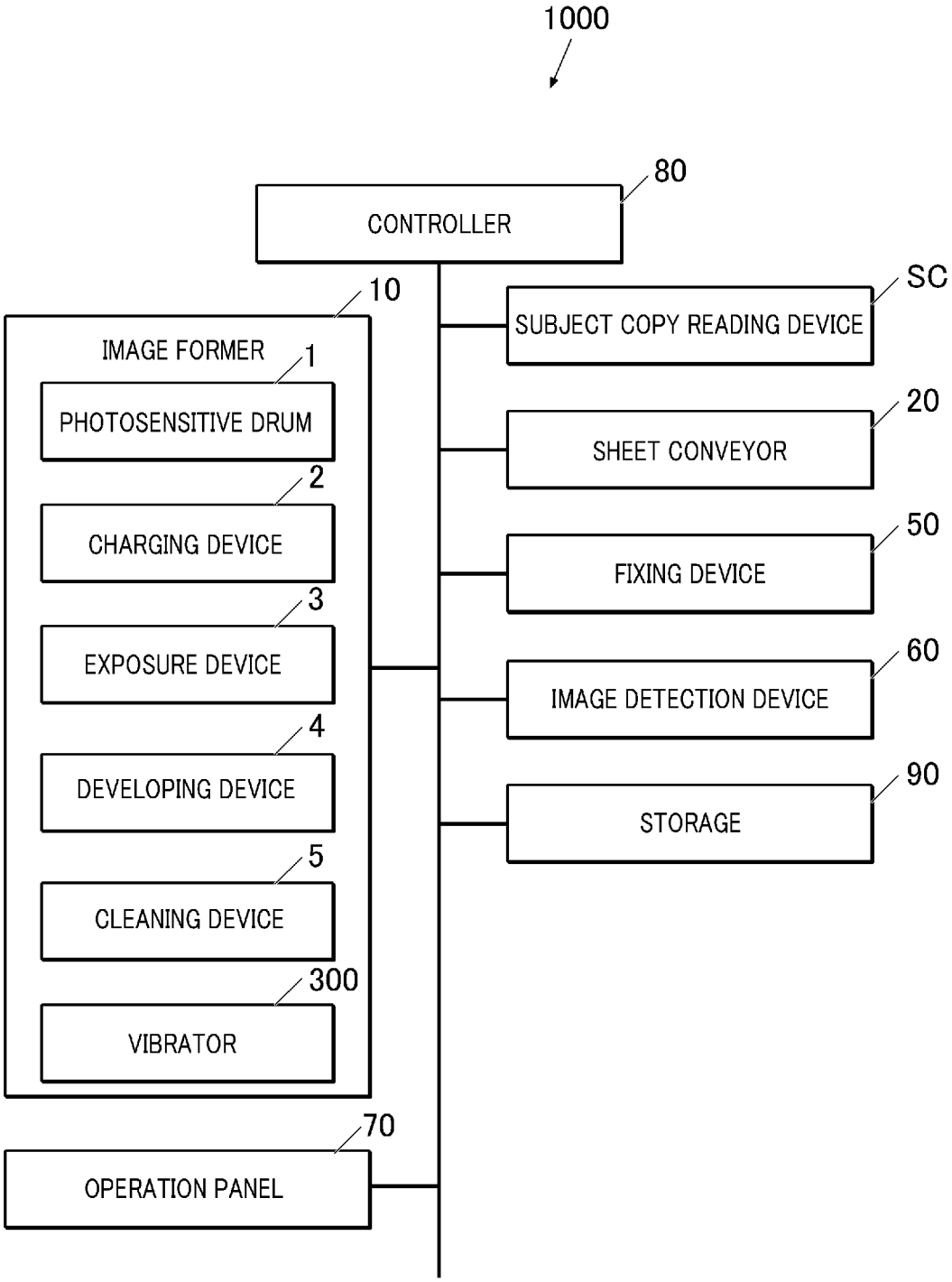
FIG. 2 is a block diagram of the image forming apparatus according to the present embodiment.

FIG. 2 is a block diagram of the image forming apparatus 1000 according to the present embodiment. The image forming apparatus 1000 includes a subject copy reading device SC, an image former 10, a sheet conveyor 20, a fixing device 50, an image detection device (image detector) 60, a vibrator 300, an operation panel 70, a controller 80 (hardware processor), and a storage 90.

(Subject Copy Reading Device)

The subject copy reading device SC illuminates an image of a subject copy with an illuminating device, and reads reflected light with a line image sensor to obtain an image signal. This image signal is subjected to processing such as A/D conversion, shading correction, and compression, and is then input to the controller 80 as printing data. The printing data input to the controller 80 is not limited to that read by the subject copy reading device SC, but may be received from a personal computer, another image forming apparatus, or a server connected to the image forming apparatus 1000, or may be read from a portable recording medium such as a USB memory, for example.

(Image Former)

The image former 10 is composed of an image former 10Y that forms a yellow (Y) image, an image former 10M that forms a magenta (M) image, an image former 10C that forms a cyan (C) image, and an image former 10K that forms a black (K) image.

The image former 10Y is mainly composed of a photosensitive drum 1Y which is an image carrier, as well as a charging device 2Y, an exposure device 3Y, a developing device 4Y, and a cleaning device 5Y arranged around the photosensitive drum 1Y. The photosensitive drum 1Y has a surface (photosensitive surface) uniformly charged by the charging device 2Y, and a latent image is formed on the surface of the photosensitive drum 1Y through scanning exposure performed by the exposure device 3Y. The developing device 4Y is a two-component development type developing device, for example, and visualizes the latent image on the photosensitive drum 1Y through development with toner. An image (a toner image) corresponding to yellow is thereby formed on the photosensitive drum 1Y. The image formed on the photosensitive drum 1Y is transferred to an intermediate transfer belt 8 which is an endless belt by a primary transfer roller. The cleaning device 5Y is provided upstream of the charging device 2Y in a rotating direction of the photosensitive drum 1Y, and removes toner remaining on the surface of the photosensitive drum 1Y after image transfer.

The image formers 10M, 10C, and 10K are respectively composed of photosensitive drums 1M, 1C, and 1K, as well as charging devices 2M, 2C, and 2K, exposure devices 3M, 3C, and 3K, developing devices 4M, 4C, and 4K, and cleaning devices 5M, 5C, and 5K respectively arranged around the image formers 10M, 10C, and 10K. Their details are similar to those of the image former 10Y. For convenience of illustration and description, common components are indicated by the same reference numbers, and in a case of distinguishing between them, Y, M, C, or K will be added to the reference numbers. In FIG. 2, the character Y, M, C, or K is omitted.

(Intermediate Transfer Belt)

The intermediate transfer belt 8 is wound around a plurality of rollers including a secondary transfer opposed roller, a belt-driven roller, and the primary transfer roller. An image transferred onto the intermediate transfer belt 8 is transferred by a secondary transfer roller 9 to a sheet P conveyed by the sheet conveyor 20 at a predetermined time. The secondary transfer roller 9 is pressed against the secondary transfer opposed roller with the intermediate transfer belt 8 interposed therebetween.

(Sheet Conveyor)

The sheet conveyor 20 conveys the sheet P along a conveyance path. The sheet P is stored in a sheet tray 21, and the sheet P stored in the sheet tray 21 is sent to the conveyance path by a sheet feeder 22. A plurality of conveyance rollers that convey the sheet P are provided on the conveyance path.

(Fixing Device)

The fixing device 50 performs fixing processing of fixing a transferred image to the sheet P. The fixing device 50 includes a pair of fixing rollers 51, 52 arranged to be pressed against each other to form a nip (fixing nip), and a heater 53 that heats the fixing roller 52. A heater such as a halogen lamp is used as the heater 53. The fixing device 50 conveys the sheet P, and fixes the image onto the sheet P by means of pressure applied by the pair of fixing rollers 51, 52 and heat applied by the heater 53.

The sheet P having undergone the fixing processing follows the conveyance path downstream of the fixing nip, and is ejected to a sheet ejection tray 30 attached to a side surface of the apparatus body. In a case of forming an image also on the rear surface of the sheet P, a switch gate 23 is switched to send the sheet P on which an image has been formed on the front surface to a reversed conveyance path for conveying the sheet P to the upstream side of the conveyance path with the sheet P turned back.

(Image Detection Device)

The image detection device 60 is an image calibration control unit (ICCU) including a linear image sensor (such as a CCD line sensor, for example), an optical system, a light source, and the like, for example, and reads the sheet P having passed through the fixing device 50 to transmit image detection data to the controller 80.

Although FIG. 1 illustrates the case in which the image detection device 60 is provided within the image forming apparatus 1000, this is not a limitation, and the image detection device 60 may be provided separately. It is sufficient for the image detection device 60 to be able to read the sheet P having passed through the fixing device 50 and to transmit image detection data to the controller 80.

(Operation Panel)

The operation panel 70 is an input portion for a user to perform an input operation. The operation panel 70 includes a display and a touch panel, for example, and enables an input operation to be performed in accordance with information displayed on the display. Through the operation on the operation panel 70, the user performs setting concerning a printing job including, for example, the sheet P, image density, magnification, and the like. The set information is acquired by the controller 80. The operation panel 70 also functions as a display controlled by the controller 80 to display various types of information to the user through the operation panel 70.

(Controller)

The controller 80 exerts control concerning the image forming apparatus 1000. A microcomputer mainly composed of a CPU, an I/O interface, and the storage 90 such as a ROM and a RAM is used as the controller 80. The CPU executes various programs (processor). The ROM stores the various programs to be executed by the CPU in the form of program codes readable by the CPU. The ROM holds data necessary for executing the programs. The RAM is a memory serving as a working memory area. The programs and data stored in the ROM are expanded onto the RAM when read by the CPU. The CPU then performs various types of processing based on the programs and data expanded onto the RAM.

[Developing Device]

Figure 3:
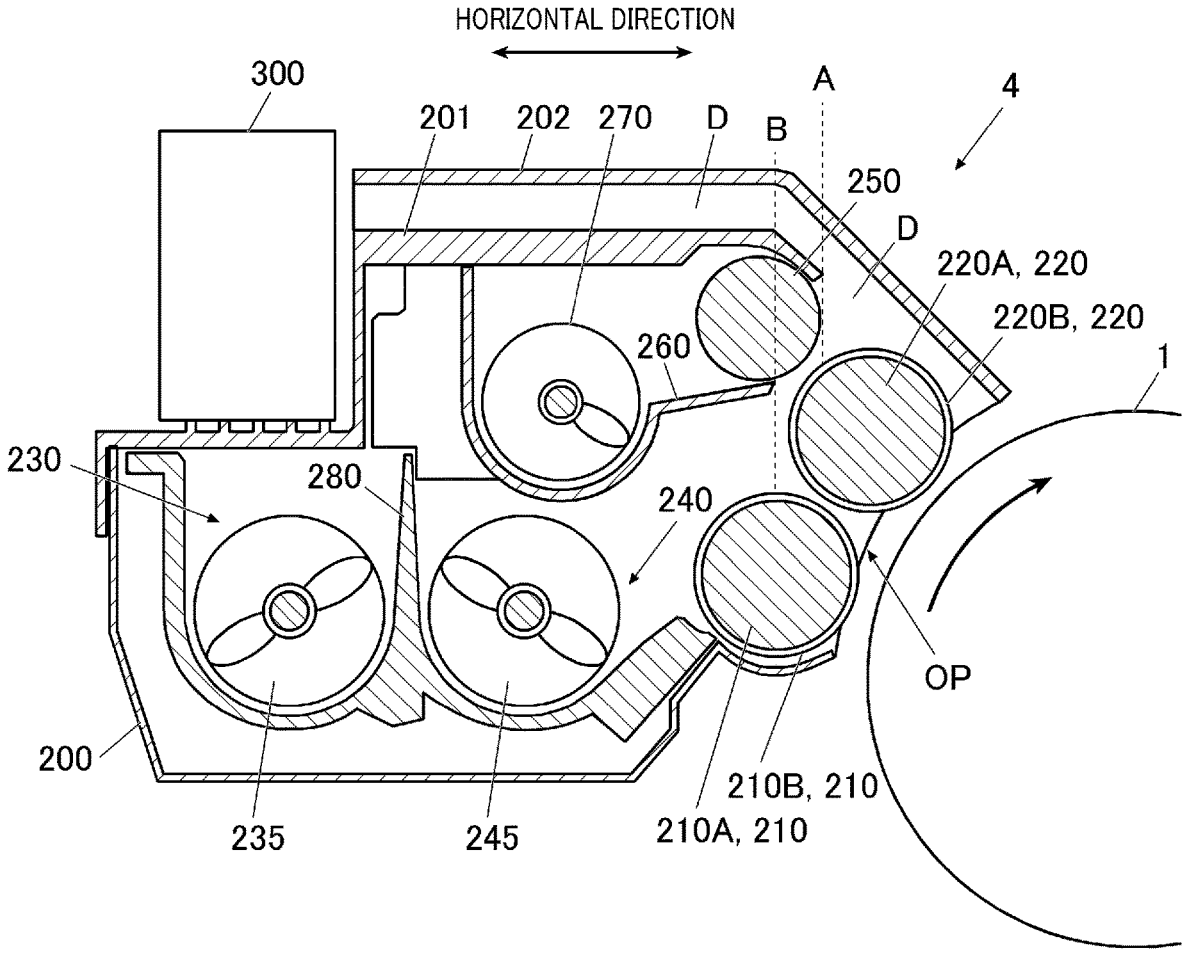
FIG. 3 is an explanatory diagram showing a configuration of a developing device.

FIG. 3 is an explanatory diagram showing a configuration of a developing device (developer) 4 according to the present embodiment. The configuration of the developing device 4 according to the present embodiment will be described below. In the following description, the developing device 4 representatively indicates the individual developing devices 4Y, 4M, 4C, and 4K respectively included in the four image formers 10Y, 10M, 10C, and 10K. Similarly, the photosensitive drum 1 representatively indicates the individual photosensitive drums 1Y, 1M, 1C, and 1K respectively included in the four image formers 10Y, 10M, 10C, and 10K. Using the horizontal direction as the base, a side opposite to the photosensitive drum 1 is called the front side of the developing device 4, and a side away from the photosensitive drum 1 is called the rear side of the developing device 4.

(Enclosure)

The developing device 4 includes an enclosure 200 that stores a developer. In response to an increase in processing speed of the image forming apparatus 1000, two developing rollers including a first developing roller 210 and a second developing roller 220 are arranged in the enclosure 200. The first developing roller 210 is arranged upstream in the rotating direction of the photosensitive drum 1, and the second developing roller 220 is arranged downstream in the rotating direction of the photosensitive drum 1. The first developing roller 210 and the second developing roller 220 are arranged at different heights in the vertical direction. In this case, in a common layout, the first developing roller 210 is arranged on the lower side, and the second developing roller 220 is arranged above the first developing roller 210. By arranging the first developing roller 210 on the lower side, the agglomerated developer is transferred to the photosensitive drum 1.

(Developer Storage Chamber)

On the rear side of the first developing roller 210 and the second developing roller 220 in the enclosure 200, a first developer storage chamber 230 and a second developer storage chamber 240 are provided. In the first developer storage chamber 230 and the second developer storage chamber 240, a first agitation and conveyance member 235 and a second agitation and conveyance member 245 are respectively provided which convey the developer while agitating, and supply the developer to the first developing roller 210 and the second developing roller 220.

(Collection Roller)

A collection roller 250 that collects the remainder of the developer is provided in the vicinity of the first developing roller 210 and the second developing roller 220. Toner collected by the collection roller 250 is supplied to a third agitation and conveyance member 270 via a guide member 260, then conveyed by the third agitation and conveyance member 270, and returned to the first developer storage chamber 230 (or the second developer storage chamber 240). As indicated by a broken line B in FIG. 3, the front end of the guide member 260 needs to project to a position overlapping the outer periphery of the first developing roller 210 using the horizontal direction as the base.

(Developer)

The developer is a two-component developer, for example, and contains resin toner and carriers. By agitating this developer, the carriers are charged positively, and the toner is charged negatively. By magnetically adsorbing the positively-charged carriers to the outer peripheral surfaces of the first developing roller 210 and the second developing roller 220, the negatively-charged toner adhering around the carriers is conveyed.

The enclosure 200 stores the developer, and also stores the first developing roller 210, the second developing roller 220, the first agitation and conveyance member 235, the second agitation and conveyance member 245, the collection roller 250, the guide member 260, and the third agitation and conveyance member 270 provided inside. The enclosure 200 is provided with an opening OP opposite to the photosensitive drum 1, and the first developing roller 210 and the second developing roller 220 are placed at this opening OP to be spaced from and opposed to the photosensitive drum 1.

(First Lid)

A first lid 201 as a plate-like component is provided at the upper part of the enclosure 200. This first lid 201 is a cover that forms the upper part of the enclosure 200 from the front side to the rear side of the developing device 4. As indicated by a broken line A in FIG. 3, the front end of the first lid 201 projects to a position overlapping the second developing roller 220 using the horizontal direction as the base. The guide member 260 described above is coupled to the first lid 201. The first lid 201 has a wide shape that covers the whole area of the enclosure 200 in the axial direction of the first developing roller 210 and the second developing roller 220.

(Second Lid)

A second lid 202 as a plate-like component is provided above the first lid 201 so as to cover the first lid 201. The second lid 202 is arranged with a space left from the first lid 201. The front end of the second lid 202 projects to the front side relative to the front end of the first lid 201 using the horizontal direction as the base, and extends so as to cover the whole area of the second developing roller 220. The second lid 202 has a wide shape that covers the whole area of the enclosure 200 in the axial direction of the first developing roller 210 and the second developing roller 220.

(Duct)

The first lid 201 and the second lid 202 form a duct D in which air flows. A suction fan (not shown) is arranged in the vicinity of the developing device 4, and when air is suctioned by this suction fan, air flows from the front side toward the rear side of the developing device 4 (from the right to the left in the drawing). This flow of air passes through the duct D formed by the first lid 201 and the second lid 202. The developer supplied by the first developing roller 210 and the second developing roller 220 may fly around the photosensitive drum 1 because of rotation of a first developing sleeve 210B and a second developing sleeve 220B. The flying developer is guided by the flow of air leading to the duct D to be collected from around the photosensitive drum 1.

(Developing Sleeve)

The first developing roller 210 includes a first magnet roller 210A and the cylindrical first developing sleeve 210B supported in a rotatable manner along the outer peripheral surface of the first magnet roller 210A. The second developing roller 220 includes a second magnet roller 220A and the cylindrical second developing sleeve 220B supported in a rotatable manner along the outer peripheral surface of the second magnet roller 220A. The first magnet roller 210A and the second magnet roller 220A have a plurality of magnetic poles magnetized in the circumferential direction, and the developer is magnetically adsorbed to or separated from the outer peripheral surfaces of the first developing sleeve 210B and the second developing sleeve 220B by the action of a magnetic force. These magnetic poles are magnetized substantially equally in the axial direction of the first magnet roller 210A and the second magnet roller 220A. A DC superimposed AC voltage as a development bias voltage is applied to the first developing roller 210 and the second developing roller 220 from a DC power source not shown.

(Agitation and Conveyance Member)

The first agitation and conveyance member 235 and the second agitation and conveyance member 245 are screw-like members arranged in the axial direction of the first developing roller 210 and the second developing roller 220, and each including a central shaft and a blade formed spirally around this central shaft. The first agitation and conveyance member 235 and the second agitation and conveyance member 245 are arranged side by side with the interposition of a partition wall 280 having openings (not shown) at both ends in the axial direction. The first agitation and conveyance member 235 and the second agitation and conveyance member 245 each convey the developer in the axial direction. The first agitation and conveyance member 235 and the second agitation and conveyance member 245 are driven rotationally so as to convey the developer in directions opposite to each other. The developer conveyed by each of the first agitation and conveyance member 235 and the second agitation and conveyance member 245 is delivered through the openings provided in the partition wall 280, and thus moves in a circulating manner between the first developer storage chamber 230 and the second developer storage chamber 240 partitioned by the partition wall 280. Part of the developer conveyed by the second agitation and conveyance member 245 is supplied to the first developing roller 210 and the second developing roller 220, and the developer is magnetically adsorbed onto the outer peripheral surfaces of the first developing roller 210 and the second developing roller 220.

[Vibrator]

Figure 4A:
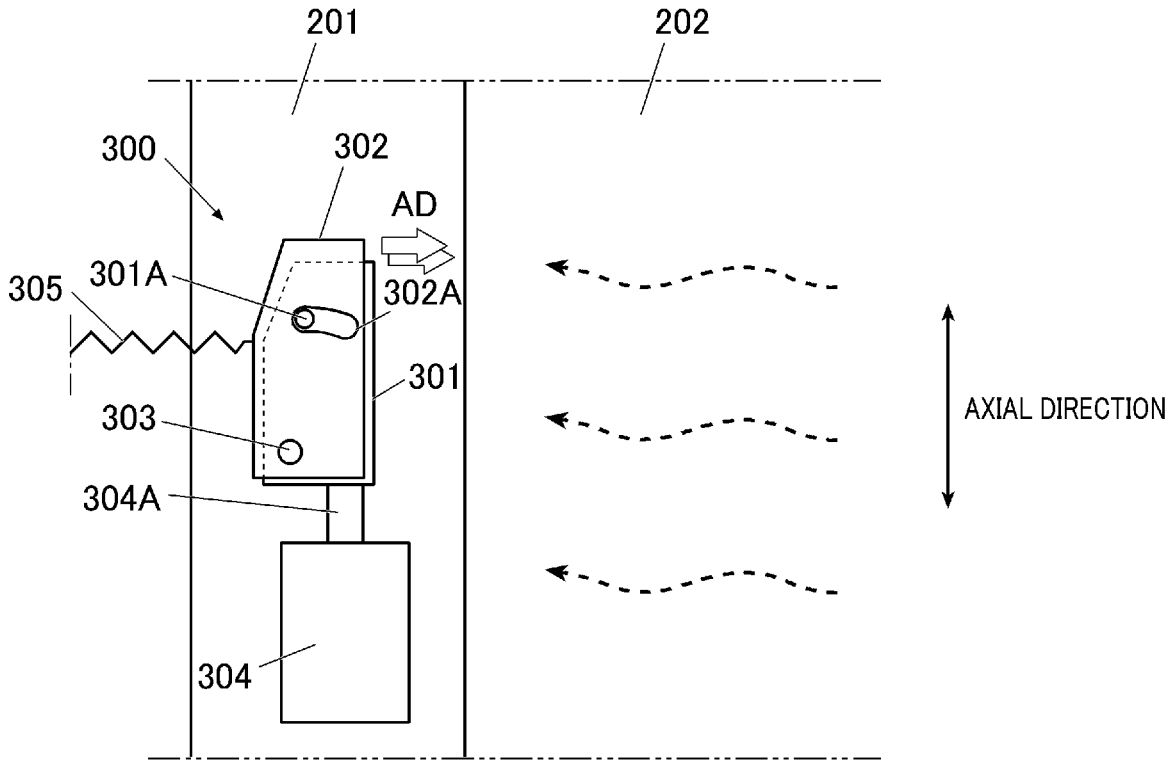
FIG. 4A and FIG. 4B are explanatory diagrams showing a configuration of a vibrator.
Figure 4B:
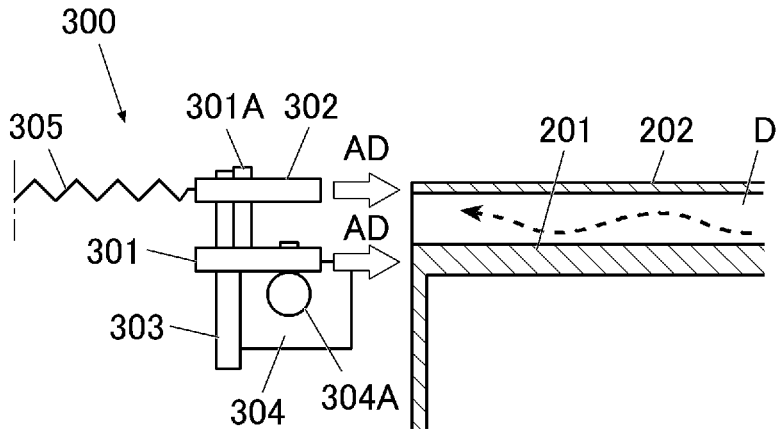

FIG. 4A and FIG. 4B are explanatory diagrams showing a configuration of the vibrator 300. In the present embodiment, the developing device 4 includes the vibrator 300 that, when toner leakage is detected on the sheet P, applies vibrations to the duct D.

The vibrator 300 is composed of a first vibrating member 301 and a second vibrating member 302 as a pair of vibrating members, an electromagnetic solenoid 304 as an electric actuator, and a return spring 305, and is arranged on the first lid 201 on the rear side of the developing device 4. That is, using the flow of air as the base, the vibrator 300 is arranged downstream of the duct D. Using the axial direction of the first developing roller 210 and the second developing roller 220 as the base, the vibrator 300 is arranged at the central position of the duct D.

(Vibrating Members)

The first vibrating member 301 and the second vibrating member 302 are components that apply vibrations to the duct D. The first vibrating member 301 and the second vibrating member 302 are coupled to a fixed shaft 303 extending through in the vertical direction, and are configured to pivot about this fixed shaft 303. The first vibrating member 301 and the second vibrating member 302 are arranged separately in the vertical direction, and the second vibrating member 302 is arranged above the first vibrating member 301. The first vibrating member 301 is arranged such that the position in the vertical direction corresponds to the first lid 201 which is a vibrated portion, and the second vibrating member 302 is arranged such that the position in the vertical direction corresponds to the second lid 202 which is a vibrated portion.

The first vibrating member 301 pivots about the fixed shaft 303 to abut on the first lid 201, thereby applying vibrations to the duct D. The second vibrating member 302 pivots about the fixed shaft 303 to abut on the second lid 202, thereby applying vibrations to the duct D. The planar direction of the first lid 201 and the second lid 202 is set as a direction AD in which the first vibrating member 301 and the second vibrating member 302 apply vibrations to the duct D. That is, vibrations are input by the first vibrating member 301 and the second vibrating member 302 not to the planar portions of the first lid 201 and the second lid 202 but to their through-thickness surfaces (end surfaces).

A columnar pin 301A is provided on the upper surface of the first vibrating member 301. An opening 302A through which the pin 301A is inserted is formed in the second vibrating member 302. The opening 302A is formed in a predetermined range along a pivot track of the pin 301A. The opening 302A allows a relative movement of the first vibrating member 301 on which the pin 301A is provided to stand, and has a function of accepting an operation force input from the pin 301A so as to cause the second vibrating member 302 to pivot toward the second lid 202.

(Electromagnetic Solenoid)

The electromagnetic solenoid 304 is a driver that causes the first vibrating member 301 to pivot. The electromagnetic solenoid 304 has a plunger 304A built-in which is suctioned into the body, and actuates the plunger 304A based on a control signal from the controller 80. The plunger 304A is coupled to the first vibrating member 301. When this plunger 304A is suctioned, the first vibrating member 301 pivots toward the first lid 201.

(Return Spring)

The return spring 305 is a member coupled to the second vibrating member 302 and having a tensile force that makes the second vibrating member 302 return to its initial position. The tensile force of the return spring 305 is set at a force smaller than the operation force input from the pin 301A of the first vibrating member 301. Therefore, when the operation force is input from the pin 301A of the first vibrating member 301, the second vibrating member 302 pivots toward the second lid 202 against the tensile force of the return spring 305.

Preferably, the developing device 4 each includes a plurality of vibrators 300, and more preferably, the plurality of vibrators 300 are different from each other in spring constant of the return spring 305 and in vibration force.

Even in a case where a significant quantity of toner is adhering to the developing device 4, for example, the provision of the plurality of vibrators 300 enables toner to be shook off in a short while by causing the plurality of vibrators 300 to apply vibrations together. Since the plurality of vibrators 300 are different from each other in vibration force, the vibrators 300 are used differently in accordance with the quantity of adhering toner, which enables more efficient vibration processing to be performed.

The spring constant of the return spring 305 is settled as appropriate based on the strength of the developing device 4 or the dropping degree of adhering toner.

[Vibrating Operation]

Figure 5A:
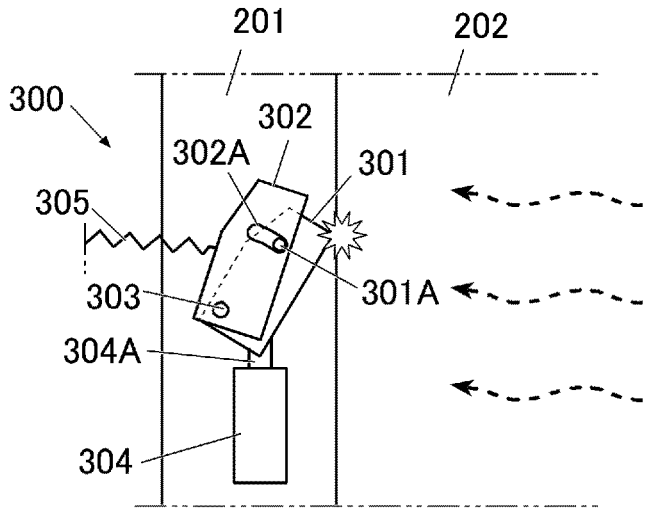
FIG. 5A to FIG. 5C are explanatory diagrams showing an operation of the vibrator.
Figure 5B:
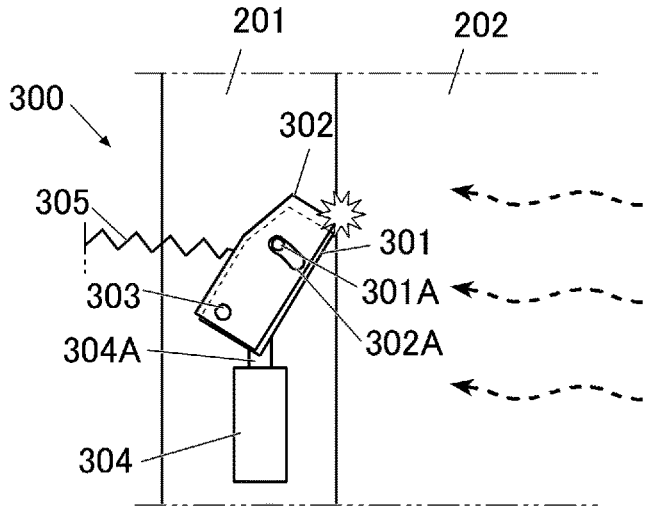
Figure 5C:
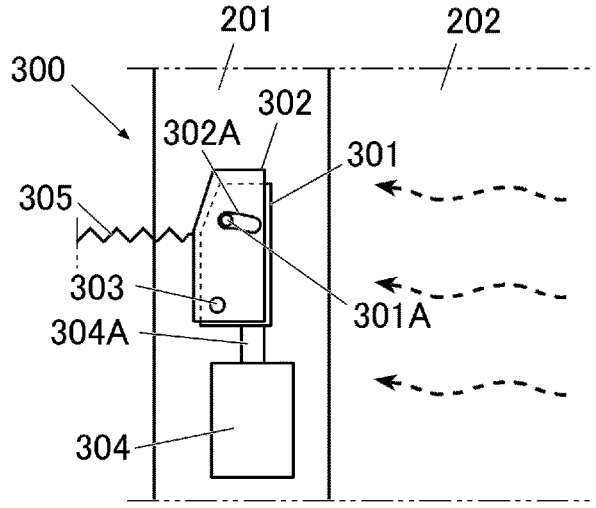

A vibrating operation of the duct D in the developing device 4 according to the present embodiment will be described below. FIG. 5A to FIG. 5C are explanatory diagrams showing the operation of the vibrator 300. First, in a case where it is settled that the vibrating operation is to be performed based on image detection data transmitted from the image detection device 60, the controller 80 outputs an ON signal to the electromagnetic solenoid 304 as a control signal. When the ON signal is input to the electromagnetic solenoid 304, the plunger 304A is suctioned.

When the plunger 304A is suctioned, the first vibrating member 301 is pulled by the plunger 304A, so that the first vibrating member 301 pivots about the fixed shaft 303. The first vibrating member 301 pivots toward the first lid 201, and finally abuts on the first lid 201. When the first vibrating member 301 abuts on the first lid 201, the impact causes vibrations to be applied to the first lid 201 (FIG. 5A).

The first vibrating member 301 preferably applies vibrations such that the first lid 201 resonates. A larger amplitude is thereby obtained.

When the first vibrating member 301 pivots toward the first lid 201, the pin 301A of the first vibrating member 301 moves within the opening 302A of the second vibrating member 302. Therefore, only the first vibrating member 301 pivots, and the second vibrating member 302 maintains its initial position under the tensile force of the return spring 305. When the first vibrating member 301 pivots further, the pin 301A abuts on the edge of the opening 302A. After abutting on the edge of the opening 302A, the pin 301A moves a slight distance, but stops when the first vibrating member 301 abuts on the first lid 201.

When the pin 301A abuts on the edge of the opening 302A, a force (operation force) is input from the pin 301A to the second vibrating member 302. When the operation force is received from the pin 301A, the operation force turns into an inertial force, and the second vibrating member 302 pivots toward the second lid 202 against the tensile force of the return spring 305. The second vibrating member 302 finally abuts on the second lid 202, and the impact causes vibrations to be applied to the second lid 202 (FIG. 5B).

The second vibrating member 302 preferably applies vibrations such that the second lid 202 resonates. A larger amplitude is thereby obtained.

When a predetermined period elapses after the ON signal is output, the controller 80 outputs an OFF signal to the electromagnetic solenoid 304 as a control signal. When the OFF signal is input to the electromagnetic solenoid 304, the plunger 304A returns to its initial position. With the return of the plunger 304A, the first vibrating member 301 pivots in the reverse direction to return to its initial position. The second vibrating member 302 receives the tensile force of the return spring 305 after abutting on the second lid 202 to pivot in the reverse direction. With the return of the first vibrating member 301 to its initial position, the second vibrating member 302 also returns to its initial position (FIG. 5C).

Through the sequential vibrating operation described above, vibrations are input to the duct D by the vibrator 300. The vibrating operation performed by the vibrator 300 is principally executed in a period in which an image is not formed in the image forming apparatus 1000 (specifically, the image formers 10Y, 10M, 10C, and 10K) in accordance with the determination made by the controller 80 so as not to degrade productivity. Examples of the period in which an image is not formed include a period between jobs, specifically, a period after a previous job is terminated and before the next job is executed, in particular, a time at which a printing operation with the passage of the sheet P is not performed, such as during an image stabilizing operation, color resist correction, or various types of operation correction. In the period between jobs, rotational control over the first developing sleeve 210B of the first developing roller 210 and the second developing sleeve 220B of the second developing roller 220 is stopped.

However, in a case where significant toner leakage is detected, for example, even during continuous printing, image formation may be suspended halfway to perform the vibrating operation.

[Settlement of Vibrating Conditions]

As to vibrations applied to the developing device 4 by the vibrator 300, it is preferable to minimize the vibrating time and the number of vibrations just to such degrees that toner adhering to the developing device 4 is shook off, in view of printing productivity and durability of the vibrator 300.

Therefore, the controller 80 according to the present embodiment settles vibrating conditions of the vibrator 300 in accordance with the level of toner leakage detected from image detection data.

Table I shows criteria for determining the toner leakage level by way of example.

The size of the most significant toner leakage adhering to the sheet P, and the number of occurrences and the occurred position per predetermined unit area, for example, are used as the criteria for determining the toner leakage level, and the controller 80 adds up scores respectively given in accordance with the determination criteria to determine the toner leakage level.

TABLE I

| | Significant leakage | Intermediate leakage | Slight leakage | Extremely slight leakage |
|---|---|---|---|---|
| Maximum length of toner leakage | 2 mm or more | 1 mm or more, and less than 2 mm | 0.5 mm or more, and less than 1 mm | less than 0.5 mm |
| The number of occurrences of toner leakage per 5 $cm^2$ | 10 or more | 5 or more, and 9 or less | 2 or more, and 4 or less | 1 |
| Leakage occurred position | within 148 mm from both ends of sheet | within 80 mm from both ends of sheet | within 50 mm from both ends of sheet | within 20 mm from both ends of sheet |
| Score | 4 | 3 | 2 | 1 |

For example, in a case where the controller 80 determines that the "maximum length of toner leakage" adhering to the sheet P is 1.5 mm, "the number of occurrences of toner leakage per 5 $cm^2$" is four, and the "leakage occurred position" is located within 75 mm from both the ends of the sheet P, the toner leakage level is determined as a score of 8 by the addition of 3+2+3.

In the present embodiment, the three determination conditions, and the size of the most significant toner leakage, the number of occurrences and the occurred position per predetermined unit area, are combined to determine the toner leakage level, but this is not a limitation, and the toner leakage level may be determined based on a combination of any two of the determination conditions, or based on any one of the determination conditions.

Table II shows by way of example vibrating conditions of the vibrator 300 in accordance with the toner leakage level. As shown in Table II, a case in which it is determined that the toner leakage level is poor (the total score is high) is assumed as a state in which much toner is adhering to the developing device 4, and toner leakage is highly likely to occur. Therefore, in order to shake off the toner reliably, vibrating conditions are settled such that a vibrator 300 having a large vibration force is mainly used to apply vibrations, and the vibrating time and the number of vibrations are increased.

In order to prevent many similar image failures from occurring, it is preferable to suspend image formation even during continuous printing, and to perform the vibrating operation as a correction operation.

A case in which it is determined that the toner leakage level is good (the total score is low) is assumed as a state in which less toner is adhering to the developing device 4, and toner leakage is unlikely to occur. Therefore, in order not to degrade the productivity excessively or deplete the vibrator 300, the vibrating conditions are settled such that a vibrator 300 having a small vibration force is mainly used to apply vibrations, and the vibrating time and the number of vibrations are decreased.

In a case where continuous printing is being performed, it is preferable in terms of productivity to perform the vibrating operation at a time synchronized with another correction operation.

in the controller 80 in advance, but may be changed arbitrarily by a user through the operation panel 70.

[Flow of Settlement of Vibrating Conditions and Vibration Processing]

Figure 6:
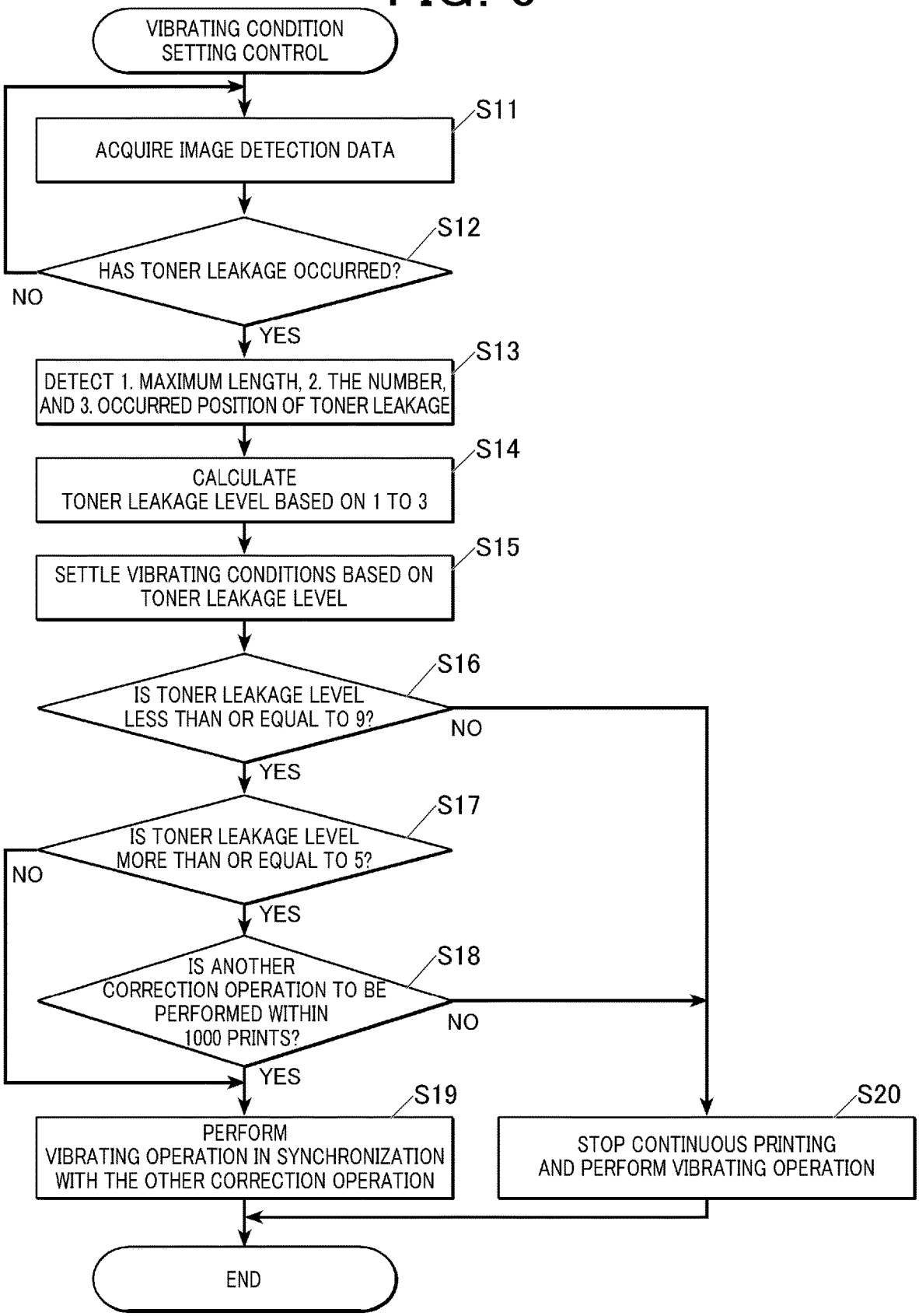
FIG. 6 is a flowchart until a controller settles vibrating conditions of the vibrator, and applies vibrations.

FIG. 6 is a flowchart showing a flow in which the image detection device 60 of the image forming apparatus 1000 according to the present embodiment reads the sheet P having passed through the fixing device 50, the controller 80 settles vibrating conditions of the vibrator 300, and the vibrator 300 applies vibrations.

The controller 80 acquires, with the image detection device 60, image detection data obtained by reading an image on the sheet P having passed through the fixing device 50 (Step S11).

Next, the controller 80 determines whether toner leakage has occurred on the sheet P based on the image detection data (Step S12).

In a case where it is determined that toner leakage has not occurred (No in Step S12), the controller 80 executes the operation in Step S11 again at a predetermined time (Step S11).

TABLE II

| Vibrating mechanism | Conditions | Vibrating condition: highest (score: 12) | Vibrating condition: higher intermediate (score: 10-11) | Vibrating condition: intermediate (score: 8-9) | Vibrating condition: lower intermediate (score: 6-7) | Vibrating condition: low (score: 4-5) | Vibrating condition: lowest (score: 3) |
|---|---|---|---|---|---|---|---|
| Vibrating mechanism having large vibration force | Vibrating time (sec) | 15 | 15 | 15 | 15 | 0 | 0 |
| | The number of vibrations | 30 | 30 | 30 | 15 | 0 | 0 |
| Vibrating mechanism having small vibration force | Vibrating time (sec) | 15 | 15 | 0 | 0 | 15 | 5 |
| | The number of vibrations | 30 | 20 | 0 | 0 | 15 | 5 |
| | Total vibrating time | 30 | 30 | 15 | 15 | 15 | 5 |
| | Total number of vibrations | 60 | 50 | 30 | 15 | 15 | 5 |

In order to facilitate distinguishing between an image and toner leakage, it is preferable to perform detection of toner leakage in a case where a printing rate on the sheet P is low, for example. In particular, since toner leakage often occurs at an end of a sheet passing region, it is more preferable to perform detection of toner leakage only in a case where the printing rate at the end of the sheet passing region is low, or in a case where a blank sheet is output.

It may be determined whether toner leakage has occurred in the developing device 4 by, for example, stopping print sheet passage as a correction operation during continuous printing and applying vibrations before outputting a waste sheet to intentionally cause toner leakage to occur on the waste sheet.

Such a configuration enables toner adhering to the developing device 4 to be shook off before toner leakage occurs on the sheet P on which an image has been formed.

It is easy to detect toner leakage on the waste sheet. Thus, as to vibrating conditions before outputting the waste sheet, the number of vibrations and the vibrating time applied by the vibrator 300 are preferably made smaller than those in the vibrating conditions described in Table II from the perspective of reducing the influence upon productivity.

Vibrating conditions in accordance with the toner leakage determination criteria described in Table I and the toner leakage level described in Table II and vibrating conditions before outputting the waste sheet are not limited to those set In a case where it is determined that toner leakage has occurred on the sheet P (Yes in Step S12), the controller 80 detects "1. Maximum length of toner leakage", "2. The number of occurrences of toner leakage per predetermined unit area", and "3. Toner leakage occurred position" based on the image detection data (Step S13).

Next, the controller 80 scores the items 1 to 3 based on Table I stored in the storage 90, and calculates the toner leakage level by adding up the scores (Step S14).

The controller 80 then settles vibrating conditions corresponding to the calculated toner leakage level referring to Table II (Step S15).

The controller 80 then determines whether the calculated toner leakage level is less than or equal to 9 (Step S16). In a case where the toner leakage level is more than or equal to 10 (No in Step S16), the controller 80 stops the continuous printing operation, performs the vibrating operation with the vibrator 300 (Step S20), and terminates the vibration processing.

In a case where the toner leakage level is less than or equal to 9 (Yes in Step S16), the controller 80 determines whether the calculated toner leakage level is more than or equal to 5 (Step S17). In a case where the toner leakage level is less than or equal to 4 (No in Step S17), the controller 80 performs the vibrating operation with the vibrator 300 at a time synchronized with another correction operation (Step S19), and terminates the vibration processing.

In a case where the toner leakage level is more than or equal to 5 (Yes in Step S17), the controller 80 determines whether a time when another correction operation is to be performed arrives within 1000 prints (Step S18).

In a case where another correction operation is not to be performed within 1000 prints (No in Step S18), the controller 80 stops the continuous printing operation, performs the vibrating operation with the vibrator 300 (Step S20), and terminates the vibration processing.

In a case where another correction operation is to be performed within 1000 prints (Yes in Step S18), the controller 80 performs the vibrating operation with the vibrator 300 at a time synchronized with the other correction operation (Step S19), and terminates the vibration processing.

Figure 7:
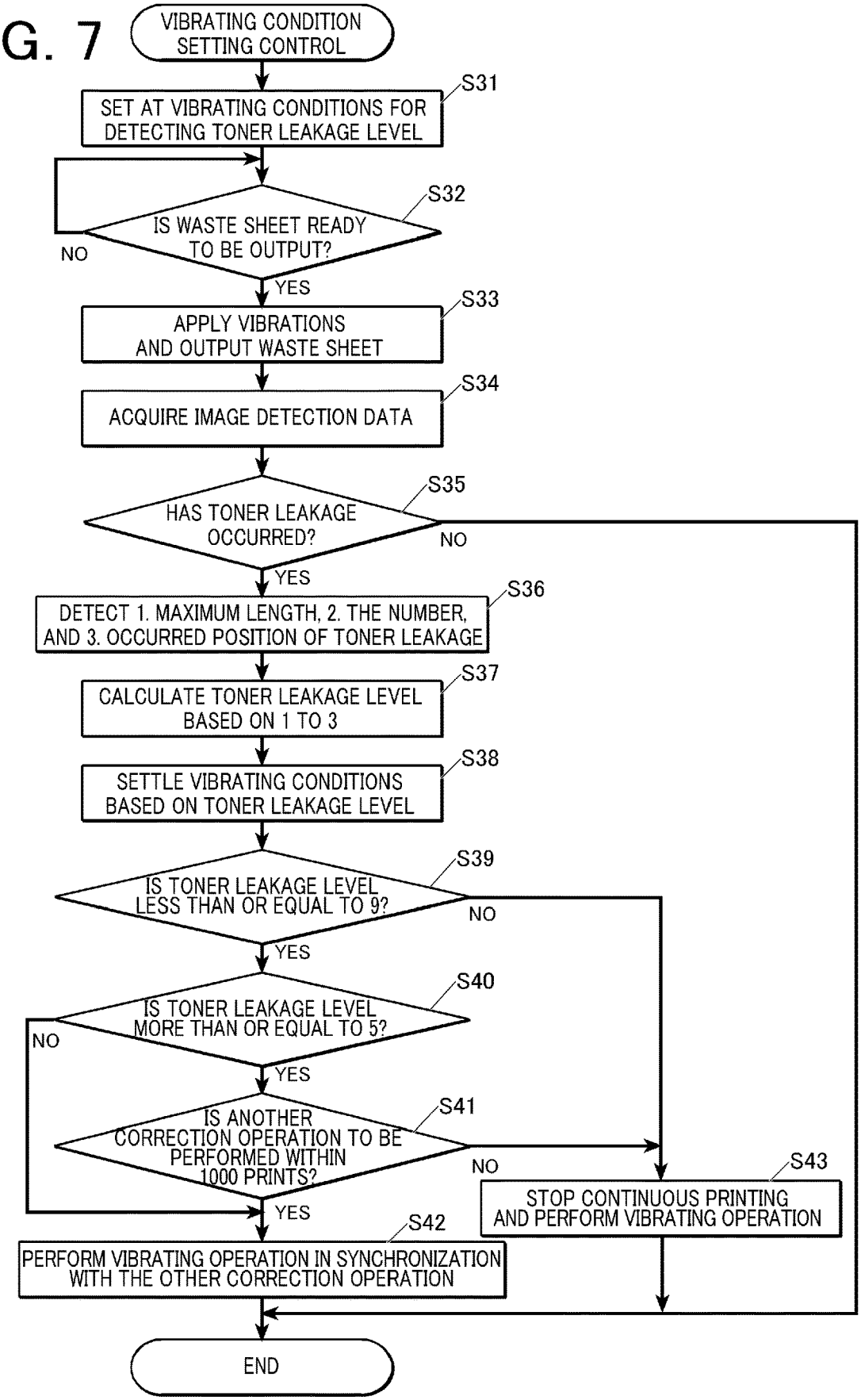
FIG. 7 is a flowchart in which a step of intentionally applying vibrations to the developing device to detect toner leakage is added.

FIG. 7 is a flowchart showing a flow, as a modification of FIG. 6, in which print sheet passage is stopped as a correction operation during continuous printing, vibrations are applied before outputting a waste sheet to intentionally cause toner leakage to occur on the waste sheet, it is determined whether toner leakage has occurred, vibrating conditions are settled in a case where toner leakage has occurred, and the vibrator 300 applies vibrations.

In this vibration processing, processing details of Steps S35 to S43 are identical to those of Step S12 to S20 although processing in Steps S31 to S34 has been added to the flowchart shown in FIG. 6, and detailed description is therefore omitted.

The controller 80 sets the vibrator 300 at vibrating conditions for detecting the toner leakage level (Step S31), and determines whether it is a time ready to output a waste sheet (Step S32).

In a case where it is not the time ready to output a waste sheet (No in Step S32), the present step is executed repeatedly until the time ready to output a waste sheet arrives.

In a case where it is the time ready to output a waste sheet (Yes in Step S32), the controller 80 applies vibrations to the developing device 4 under the vibrating conditions for detecting the toner leakage level, and then outputs the waste sheet (Step S33).

Next, the controller 80 acquires, with the image detection device 60, image detection data obtained by reading an image on the waste sheet having passed through the fixing device 50 (Step S34).

Although determination conditions based on specific numeric values are shown by way of example in Steps S16 to S18 (Steps S39 to S41), these are merely examples, and are not for limitation.

In Step S18 (Step S41), BK toner and less visible Y toner may be varied in the number of prints. For example, for the BK toner, it may be determined whether another correction operation is to be performed within 1000 prints, while for the Y toner, it may be determined whether another correction operation is to be performed within 3000 prints.

The image forming apparatus 1000 according to the present embodiment includes the vibrator 300 that applies vibrations to the vibrated portion of the developing device 4, and the controller 80 that controls the vibrator 300. The controller 80 determines the toner leakage level based on image detection data of the sheet P read by the image detection device 60, and settles vibrating conditions of the vibrator 300 in accordance with the toner leakage level. The controller 80 then causes the vibrator 300 to perform the vibrating operation under the settled vibrating conditions.

With this configuration, the vibrating conditions of the vibrator 300 are settled in accordance with the toner leakage level, and vibrations are applied. Thus, toner is shook off efficiently at a suitable time, so that an image failure is restrained.

In the present embodiment, the vibrator 300 applies vibrations such that resonance of the vibrated portion occurs.

With this configuration, the amplitude of the vibrated portion is increased, so that toner is shook off efficiently.

In the present embodiment, the developing device 4 includes the plurality of vibrators 300, and the controller 80 settles the vibrating conditions individually for each of the vibrators 300 in accordance with the toner leakage level.

With this configuration, in a case where the quantity of adhering toner is large, the plurality of vibrators 300 are caused to apply vibrations together, so that toner is shook off efficiently in a short while.

In the present embodiment, the plurality of vibrators 300 have vibration forces different from each other.

With this configuration, the plurality of vibrators 300 having vibration forces different from each other are used differently depending on whether the quantity of adhering toner is large or small, so that toner is shook off more efficiently.

In the present embodiment, the controller 80 performs sheet passing processing after causing the vibrators 300 to perform the vibrating operation under the vibrating conditions for detecting the toner leakage level.

With this configuration, the controller 80 detects a toner adhering status before toner leakage occurs on the sheet P on which an image has been formed.

In the present embodiment, the first vibrating member 301 and the second vibrating member 302 are used for one vibrator 300 to apply vibrations to the duct D. However, the vibrator 300 may be configured to include only a single vibrating member. In the case of using a single vibrating member, vibrations may be applied only to the upper side of the duct D or only to the lower side of the duct D, or a thick structure may be adopted in which vibrations are applied to both the upper and lower sides of the duct D at the same time. Alternatively, the vibrator 300 may include three or more vibrating members.

In the present embodiment, the vibrators 300 are arranged at the central position of the duct D in the axial direction of the first developing roller 210 and the second developing roller 220. Vibrations are thereby applied to the center of the duct D, and are thus transmitted to the whole area of the duct D in a balanced manner.

However, toner adhering positions vary in accordance with operating conditions such as the shape of the duct D, distribution (grayscale) of an image in a page, and unique device properties of the image formers 10Y, 10M, 10C, and 10K. On the other hand, the vibrating conditions of the duct D differ in accordance with the arrangement condition of the vibrators 300 in the axial direction. For example, the vibrating mode of the duct D (that is, the mode in which the duct D vibrates) is different between a case of applying vibrations to the center of the duct D and a case of applying vibrations to the end of the duct D. Therefore, the arrangement condition of the vibrators 300 may be changed in accordance with the toner adhering position and the number of the vibrators 300. By changing the vibrating mode of the duct D in accordance with the arrangement condition of the vibrators 300, toner is shook off appropriately.

In the present embodiment, the position of the vibrators 300 is fixed. However, by receiving a driving force from a driving mechanism or utilizing a user manual operation, the position of the vibrators 300 may be varied based on the above-described operating conditions.

In the present embodiment, the controller 80 operates the vibrators 300 in a period in which an image is not formed, specifically, in a period between jobs to apply vibrations to the duct D.

With this configuration, even in a case where toner is dropped onto the photosensitive drum 1, an image failure is restrained from occurring.

In the present embodiment, the period between jobs is indicated as an example of the period in which an image is not formed. However, the vibrators 300 may be operated to apply vibrations to the duct D in what is called an inter-sheet period, that is, in a period between the end of image formation on a previous sheet P and the start of image formation on a succeeding sheet P.

The controller 80 may distinguish which developing device 4 among the developing devices 4Y, 4M, 4C, and 4K toner is adhering to, based on the color of toner leakage, and may apply vibrations only to the relevant developing device 4.

With this configuration, toner is shook off more efficiently.

Although the image forming apparatus 1000 and program according to an embodiment of the present invention have been described above, the present invention is not limited to the above-described embodiment, and it is obviously possible to derive various modifications within the scope of the invention.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus including a developer that performs development with toner, the image forming apparatus comprising:

a vibrator that applies vibrations to a vibrated portion of the developer; and a hardware processor that controls the vibrator, wherein the hardware processor determines a toner leakage level based on a result of detecting toner leakage adhering to a sheet caused by the image forming apparatus, settles a vibrating condition of the vibrator in accordance with the toner leakage level, and causes the vibrator to perform a vibrating operation under the settled vibrating condition.

2. The image forming apparatus according to claim 1, wherein the vibrator applies vibrations such that resonance of the vibrated portion occurs.

3. The image forming apparatus according to claim 1, comprising an image detector that detects toner leakage adhering to a sheet, wherein the hardware processor determines the toner leakage level based on a result of detecting toner leakage detected by the image detector.

4. The image forming apparatus according to claim 1, wherein a criterion for determining the toner leakage level includes a size of most significant toner leakage on the sheet.

5. The image forming apparatus according to claim 1, wherein a criterion for determining the toner leakage level includes the number of occurrences of toner leakage per predetermined unit area on the sheet.

6. The image forming apparatus according to claim 1, wherein a criterion for determining the toner leakage level includes a position at which toner leakage has occurred on the sheet.

7. The image forming apparatus according to claim 1, wherein the hardware processor settles the number of vibrations applied by the vibrator as the vibrating condition in accordance with the toner leakage level.

8. The image forming apparatus according to claim 1, wherein the hardware processor settles a vibrating time of the vibrator as the vibrating condition in accordance with the toner leakage level.

9. The image forming apparatus according to claim 1, comprising a plurality of vibrators, each being identical to the vibrator, wherein the hardware processor settles the vibrating condition individually for each of the vibrators in accordance with the toner leakage level.

10. The image forming apparatus according to claim 9, wherein the plurality of vibrators have vibration forces different from each other.

11. The image forming apparatus according to claim 1, wherein the hardware processor causes the vibrator to perform the vibrating operation while the developer is not performing development processing.

12. The image forming apparatus according to claim 1, wherein the hardware processor performs sheet passing processing after causing the vibrator to perform the vibrating operation under a vibrating condition for detecting the toner leakage level.

13. The image forming apparatus according to claim 12, wherein in the vibrating condition for detecting the toner leakage level, the number of vibrations and a vibrating time of the vibrator are smaller than in the vibrating condition.

14. A non-transitory recording medium storing a computer readable program that causes a computer of an image forming apparatus including a developer that performs development with toner, and a vibrator that applies vibrations to a vibrated portion of the developer to perform:

determining a toner leakage level based on a result of detecting toner leakage adhering to a sheet caused by the image forming apparatus, settling a vibrating condition of the vibrator in accordance with the toner leakage level, and causing the vibrator to perform a vibrating operation under the settled vibrating condition.

* * * * *